US007644539B2

(12) United States Patent
Baxter

(10) Patent No.: US 7,644,539 B2
(45) Date of Patent: Jan. 12, 2010

(54) AUTOMATIC DOOR BOTTOM AND SILL ASSEMBLAGE

(76) Inventor: Stephen Marshall Baxter, 4708 N. Tuttle Ave., Sarasota, FL (US) 34234

( * ) Notice: Subject to any disclaimer, the term of this patent is extended or adjusted under 35 U.S.C. 154(b) by 451 days.

(21) Appl. No.: 11/451,151

(22) Filed: Jun. 13, 2006

(65) Prior Publication Data

US 2006/0283087 A1 Dec. 21, 2006

Related U.S. Application Data

(60) Provisional application No. 60/692,351, filed on Jun. 21, 2005.

(51) Int. Cl.
*E06B 7/20* (2006.01)

(52) U.S. Cl. ..... 49/303; 49/313; 49/470

(58) Field of Classification Search ..... 49/303, 49/306, 309, 310, 313, 467, 469, 470
See application file for complete search history.

(56) References Cited

U.S. PATENT DOCUMENTS

| | | | | | |
|---|---|---|---|---|---|
| 733,295 | A | * | 7/1903 | Stites | 49/311 |
| 888,131 | A | * | 5/1908 | Wade | 49/314 |
| 1,520,584 | A | * | 12/1924 | Lundeen | 49/310 |
| 2,032,698 | A | * | 3/1936 | Grady | 49/303 |
| 2,033,241 | A | | 3/1936 | Hawk | |
| 2,433,331 | A | | 12/1947 | Beck | |
| 3,131,441 | A | * | 5/1964 | Cornell | 49/480.1 |
| 3,250,314 | A | | 5/1966 | Wetzel | |
| 3,263,366 | A | * | 8/1966 | Woloohojian et. al. | 49/314 |
| 3,418,753 | A | * | 12/1968 | Hanson | 49/308 |
| 3,871,133 | A | | 3/1975 | Ellingston, Jr. | |
| 4,170,846 | A | * | 10/1979 | Dumenil et al. | 49/303 |
| 4,283,844 | A | | 8/1981 | Dumenil et al. | |
| 4,283,884 | A | * | 8/1981 | Dumenil et al. | 49/307 |
| 4,348,836 | A | * | 9/1982 | Dumenil et al. | 49/311 |
| 4,406,088 | A | | 9/1983 | Berndt, Jr. | |
| 4,425,738 | A | | 1/1984 | Christensen | |
| 4,614,060 | A | * | 9/1986 | Dumenil et al. | 49/303 |
| 4,703,586 | A | * | 11/1987 | Smith et al. | 49/307 |
| 4,805,345 | A | | 2/1989 | Ohi | |
| 4,947,584 | A | | 8/1990 | Wexler | |
| 5,454,192 | A | | 10/1995 | Adler et al. | |
| 5,642,588 | A | | 7/1997 | Sowers | |
| 6,058,654 | A | * | 5/2000 | Rissone | 49/314 |

(Continued)

FOREIGN PATENT DOCUMENTS

EP 1221529 A1 * 7/2002

*Primary Examiner*—Katherine W Mitchell
*Assistant Examiner*—Michael J Keller

(57) ABSTRACT

A door sill and a sealing mechanism engage one another analogously to a rack and pinion in order to automatically create a weather-resistant closure at the gap between an inswinging exterior door bottom and the floor below. The sealing mechanism, which fastens to the door bottom, contains a door-wide rotating shaft with an arm extension tipped with a flexible seal. On the underside of the shaft extension is a short "pinion" component with elongated teeth that engage in corresponding recesses in the sill, raising and lowering the seal in the process. The pinion is positioned on the far lock side of the door, so that the teeth engage and the seal begins to drop only when the door is nearly closed. As the door opens and the seal rises, a magnet further retracts the shaft extension and retains it until the door is again closed.

4 Claims, 4 Drawing Sheets

U.S. PATENT DOCUMENTS 6,125,584 A 10/2000 Sanders
6,195,939 B1 3/2001 Sowers
6,266,924 B1 7/2001 Rissone
6,381,905 B1 5/2002 Rissone

* cited by examiner

AUTOMATIC DOOR BOTTOM AND SILL ASSEMBLAGE

CROSS-REFERENCE TO RELATED APPLICATIONS

This application succeeds Provisional Patent Application 60/692,351. That provisional application was filed Jun. 21, 2005 under the title "Weather-Resistant Door-Floor Interface Assembly."

BACKGROUND OF THE INVENTION

1. Field of the Invention

The invention is an "assemblage" in that it consists of two main components: a retractable door seal attached to the underside of an inswinging door and a floor sill against which it tightly presses. The movement of the seal down towards the sill is actuated by the closure of the door itself.

The design of fenestration products must meet architectural needs but also satisfy various government regulations that sometimes work at odds to one another. Post-Hurricane Andrew building codes require ever tighter closure of such products against very high onslaughts of wind and rain. But other regulations make that job more difficult. The American with Disabilities Act, for example, limits the overall height of primary entry-door sills to only a half inch in order that they accommodate wheelchairs.

Most inswinging exterior doors feature a simple rubber-like flap on the bottom that seats against the sill, or an elongated bulb in the sill that seats against the door bottom, or a combination. Again, codes limit the pressure needed to open and close these doors, so the seal cannot be too tight, certainly not tight enough keep out wind-driven rain.

The invention described herein is presented as a solution to this dilemma. By using the closing movement of the heavy door to inter-engage the door bottom mechanism with the sill, which in turn pivots the seal down hard against the sill, a much tighter closure can be attained. Because it does not rely on rubber components undergoing an extended compression and abrasion, it can do so without out making the door too hard to close (and reopen). And because the sill is engaged just before the door latches, the seal can drop down to the weather side of what little elevation "dam" in the sill the ADA permits (one-quarter inch).

When the door is reopened, the disengagement of the door bottom mechanism and the sill swings the seal up and over any such dam and, with the help of a magnet, retracts the components of the door bottom mechanism far enough so that they will not rub on the interior floor covering.

2. Description of the Prior Art

Automatic door bottoms are currently commercially available. Typically, they feature a horizontal actuating member that protrudes from the hinge stile of the door. As the door is closed and the protrusion mashes against the door jamb, the horizontal member is moved laterally. That movement is then converted by the use of springs—by bowing leaf-type springs, for example—to move a seal down vertically against the door sill.

Commercially available devices may keep out dust and non-conditioned air on a still day, but the seal produced by the relatively weak springs is not nearly strong enough to keep out wind-driven rain. (The installation instructions typically say to adjust the seal so that it just touches the sill.)

The devices, which mount either under the bottom rail of the door or on the exterior face of the door, are designed for outswinging doors. While a face-mounting device could theoretically be shimmed out beyond the face of the door far enough to work on an inswinging door (the protrusion would mash against the door stop rather than the jamb), this would create new water-infiltration problems around the perimeter of the door-bottom device.

Accommodating an inswinging door is very important because many entry doors are designed to operate this way, especially those used in condominium and apartment buildings. Out-opening doors in such buildings require by code much wider exterior hallways in which to swing and therefore dictate a bigger, more expensive structure. Also, outswinging doors are awkward and more subject to catching in the wind.

Inswinging doors do present more of a challenge in terms of preventing water infiltration, however.

Thus it is an object of the current invention to accommodate inswinging doors.

In doing so, it is an object of the invention to present an apparatus that will automatically create a storm-resistant seal between the door and sill each time the door is closed; and to automatically release that seal as the door is opened.

Additionally, it is an object of the invention to use only components which are sturdy enough in design and simple enough in function to repeatedly stand up to storm-like conditions (no springs, for example).

Also, it is an object of the invention to provide such a seal in a way that does not adversely affect the seals between the other edges of the door and the door frame.

Further, it is an object of the invention to present an apparatus that will automatically create a storm-resistant seal between the door and sill each time the door is closed; and to automatically release that seal as the door is opened.

Further, it is an object to provide said seal without requiring an unreasonable effort on the part of the person opening and closing the door.

Finally, it is an object that the sealing apparatus and the sill be easily trimmed to length without special tools, so that the invention could be used as a retrofit product on its own as well as a new-door component. (Since an existing door would itself also have to be trimmed to the proper height above the floor, the retrofit application would be limited to wood or other trimmable doors.)

BRIEF SUMMARY OF THE INVENTION

The present invention is designed to automatically seal an exterior door—most particularly an inswinging door—at the interstice between the bottom of the door and the floor beneath it—and to do so in a manner compliant with building codes and other government regulations such as the Americans with Disabilities Act.

The invention is an assemblage consisting of a sealing mechanism within a housing which attaches to the bottom of the door and a corresponding floor sill into which the mechanism engages as the door is closed. That engagement causes a rubber-like strip to pivot down tightly against the sill across its entire length, creating the weather-resistant seal.

As the door is opened, the sealing mechanism and the sill disengage, and the sealing strip retracts back up into the housing.

DETAILED DESCRIPTION OF THE INVENTION

The detailed embodiments of the invention disclosed herein are merely exemplary of the invention which may be embodied in other forms, and therefore are not intended to be limiting in nature.

Figure 1:
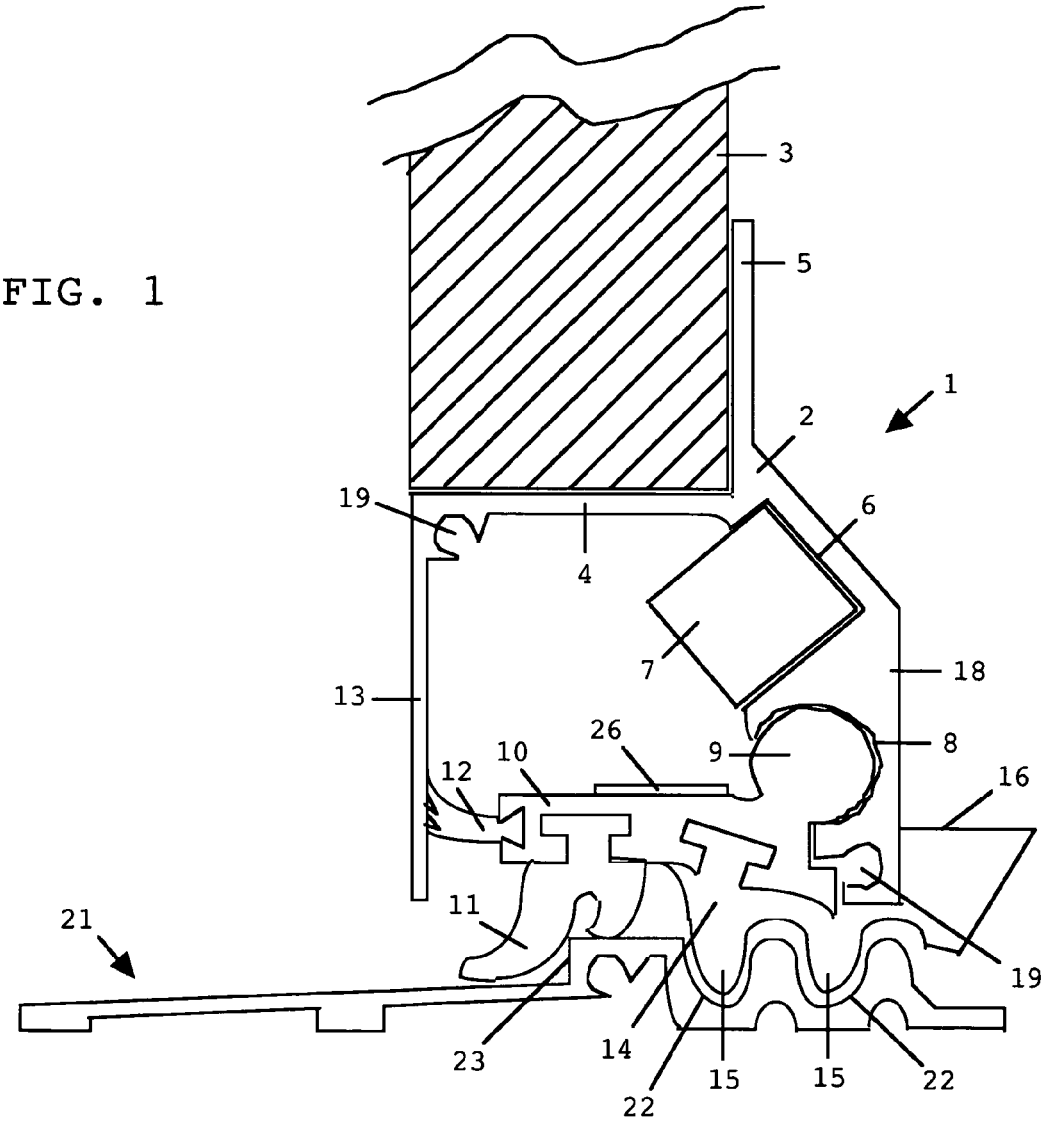
FIG. 1 is a vertical cross-section showing the door closed, the door-bottom mechanism fully engaged with the sill, and the rubber-like seal compressed tightly against the sill. (Note: the section is taken through the area of engagement; see FIG. 4.)
Figure 2:
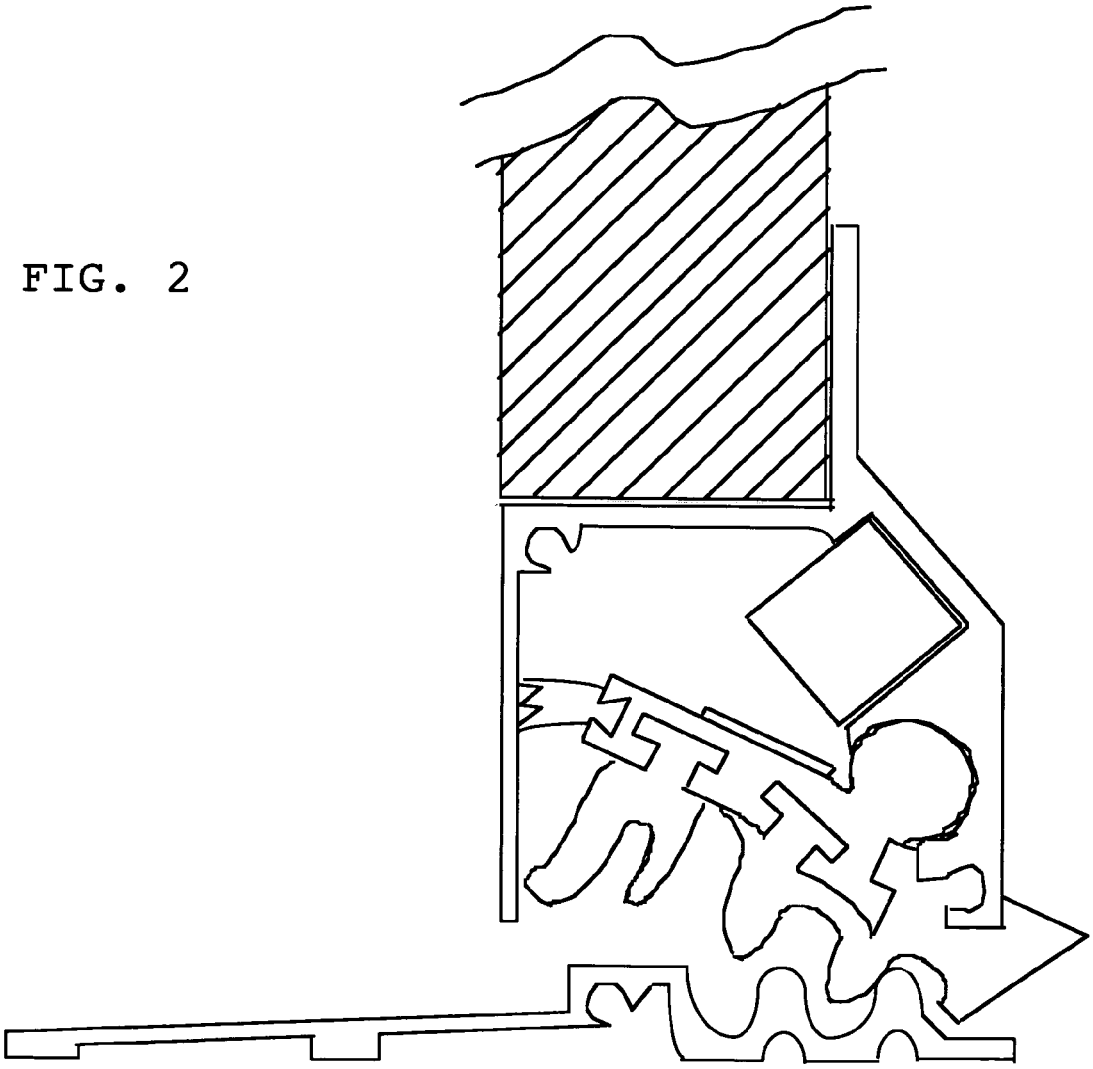
FIG. 2 is the same as FIG. 1, except that the door is beginning to open and the components are disengaging.
Figure 3:
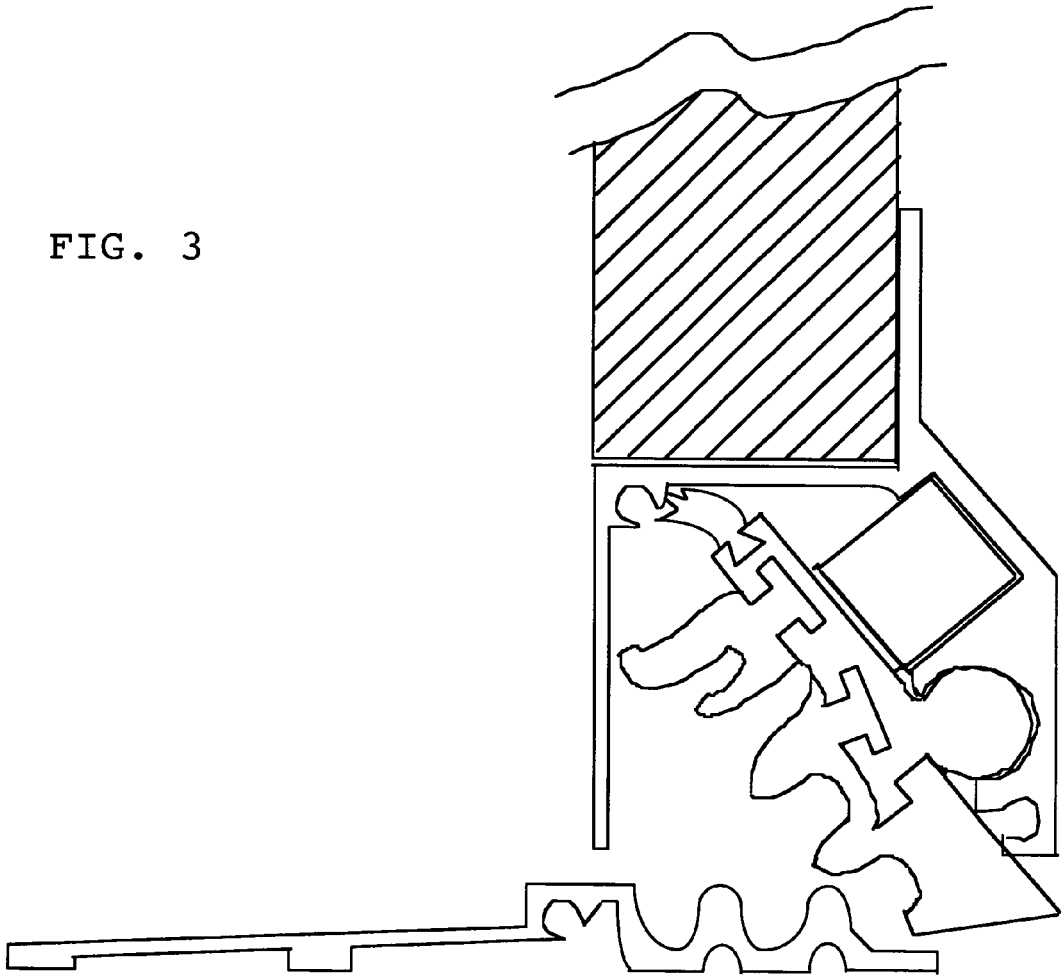
FIG. 3 is the same as FIG. 2, except that the door is open far enough so that the components are disengaged and the rubber-like seal is fully retracted.
Figure 4:
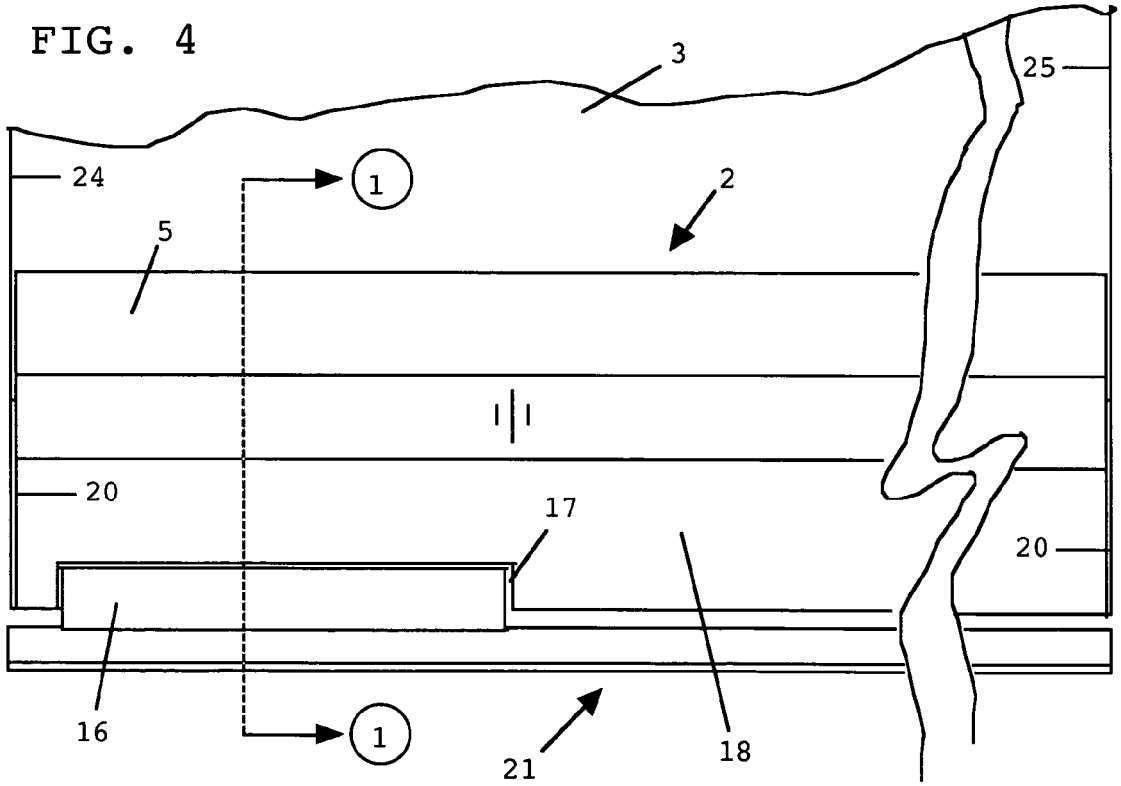
FIG. 4 is a rear elevation of the bottom of the closed door showing the engaging component protruding through the sealing-mechanism housing.

Reference numbers of parts are shown in FIG. 1 and FIG. 4, but not in FIG. 2 and FIG. 3, since the viewable parts in the latter are exactly the same as those in FIG. 1.

The sealing mechanism 1 consists of a generally inverted h-shaped housing 2 which is fastened to the bottom of—and runs the width of—an exterior door 3. (The fasteners, not shown, could pass into the door 3 through the horizontal part 4 of the housing 2 and/or through the flange 5 located on the interior side of the door 3.)

Integral to the housing 2 are an elongated recess 6 for accommodating a generally square magnet 7 at any point along its width and a tubular recess 8, open on one side, containing a separate rotating cylindrical shaft 9 with an arm extension 10 to the underside of which is fastened a flexible seal 11. At the end of the arm is a weatherstrip 12 which seals against the exterior-most wall 13 of the housing 2. (The recesses 6 & 8, the shaft 9, arm 10, seal 11, and weatherstrip 12 run the entire width of the housing 2.)

Also attached to the underside of the extension arm 10 is an engaging component referred to herein as a "pinion" 14 with teeth-like appendages—or "teeth" 15—on the bottom, and a pedal-like extension—or "pedal" 16—which protrudes through an open slot 17 in the lower interior wall 18 of the housing 2.

The housing 2 also features two screw bosses 19 for accepting screws (not shown) which fasten thin caps 20 to each end of the housing 2 in order close off the open ends.

The sealing apparatus 1 engages with the sill 21 as the door 3 is opened and closed, raising and lowering the seal 11 in the process. Integral to the sill are grooves 22 which correspond to—and accommodate—the teeth 15 in the pinion 14.

As the door 3 is closed and the teeth 15 contact the sill 21 and mesh with the grooves 22 therein, the shaft 9 turns in its recess 8, the extension arm 10 pivots down, and the seal 11 is pressed down hard against the sill 21 on the weather side of a vertical elevation in the sill referred to herein as a "dam 23," forming a tight closure. The seal may additionally (as shown) or alternately press against the top of the dam 23.

The pinion 14 is fastened to the extension arm 10 on the far lock side 24 of the door 3, so that the teeth 15 engage and the seal 11 begins to drop only when the door 3 is nearly closed. Because the door 3 pivots from its hinge side 25, the pinion 14 approaches the sill 21 at a slight angle. But the pinion 14 is short enough and the clearances between the teeth 15 and the grooves 22 great enough so that such an angled approach does not inhibit engagement.

As the door 3 opens and the extension arm 10 pivots up, the pull of the magnet 7 acting upon a ferrous keeper 26 snaps the extension arm father yet up into the housing 2 and retains it there until the door 3 is again closed.

What is claimed is:

1. An assemblage of components which in combination automatically and weathertightly seal a space at an interstice between a bottom edge of an inswinging exterior door and a door sill below it each time the door is closed, comprising:

a sealing apparatus fastened to the underside of the door bottom edge consisting of a housing containing a generally cylindrical shaft running the substantial width of the door, an engaging component connected to the shaft, and an elongated arm protruding from the shaft with a flexible seal running the arm's length parallel to the shaft;

a corresponding sill with accommodations for the engagement of the aforementioned engaging component, which engagement—initiated by the closing of the door—rotates the shaft so that the arm descends and forces the flexible seal against the sill, creating a weathertight closure;

the aforementioned engaging component consisting of a pinion fastened to, and rotating with, the sealing-apparatus shaft under a swinging edge of the door, said swinging edge being opposite a pivoting edge of the door;

the aforementioned pinion containing tapered, elongated teeth which, as the door is closing, engage in correspondingly inversely tapered and sized grooves in the top of the sill, running the length thereof, the engagement rotating the shaft and lowering the arm and seal in the process;

the aforementioned pinion-and-sill engagement, which also serves to reverse the rotation of the shaft as the door is opened—raising the arm and seal clear of the sill and the floor to the interior thereof until the pinion and sill are fully disengaged.

2. The assemblage in claim 1, wherein a magnet holds the disengaged arm in a retracted position up inside the housing, clear of the floor to the interior of the sill, until the door is again closed and the pinion and sill re-engage.

3. The assemblage in claim 1, wherein the sill includes an elevated dam, the flexible seal contacting the sill to the exterior of, and/or on top of, said dam.

4. The assemblage in claim 1, wherein, when the door is closed, an extension of the pinion protrudes through a slot in the housing on the interior side of the door, to serve as a lever to aid in the disengagement of the pinion and the sill should the door become jammed shut.

* * * * *